United States Patent [19]

Koschinek et al.

[11] 4,181,697

[45] Jan. 1, 1980

[54] PROCESS FOR HIGH-SPEED SPINNING OF POLYAMIDES

[75] Inventors: Gunter Koschinek, Dietzenbach; Dietmar Wandel, Muhlheim, both of Fed. Rep. of Germany

[73] Assignee: Zimmer Aktiengessellschaft, Fed. Rep. of Germany

[21] Appl. No.: 913,893

[22] Filed: Jun. 8, 1978

Related U.S. Application Data

[63] Continuation of Ser. No. 670,042, Mar. 24, 1976, abandoned.

[30] Foreign Application Priority Data

Apr. 5, 1975 [DE] Fed. Rep. of Germany ..... 2514874

[51] Int. Cl.[2] ..... D01F 7/04

[52] U.S. Cl. ..... 264/176 F; 264/235

[58] Field of Search ..... 264/210 F, 176 F

[56] References Cited

U.S. PATENT DOCUMENTS

| | | | |
|---|---|---|---|
| 2,957,747 | 10/1960 | Bowling | 264/210 F |
| 3,946,100 | 3/1976 | Davis et al. | 264/210 F |
| 3,987,136 | 10/1976 | Schippers | 264/210 F |
| 3,994,121 | 11/1976 | Adams | 264/210 F |
| 4,093,147 | 6/1978 | Bromley et al. | 264/210 F |

FOREIGN PATENT DOCUMENTS

| | | | |
|---|---|---|---|
| 2117659 | 10/1972 | Fed. Rep. of Germany | 264/210 F |
| 986505 | 3/1951 | France . | |
| 48-28012 | 8/1973 | Japan | 264/210 F |
| 357144 | 11/1961 | Switzerland . | |

*Primary Examiner*—Jay H. Woo

*Attorney, Agent, or Firm*—Allegretti, Newitt, Witcoff & McAndrews

[57] ABSTRACT

A method for draw-off of polyamide threads at very high speeds, say 1800 to 5000 m/min, while maintaining high quality threads and producing stable packages. The method comprises heat treating the threads, after an initial air-blast cooling, by passing them through a spinning duct the walls of which are heated to a preselected temperature below 140° C. and above $T_{min}$. Minimum calculated from the following equation:

$$T_{min} = \frac{5500 - v}{33} + T_a\,(°C.)$$

wherein v=draw-off speed in m/min, and $T_a$ is a temperature value=O for spinning ducts over 1500 mm in length, or 6° C. for each 100 mm reduction in duct length under 1500 mm. The heat treated threads are subjected to a finishing and wetting operation and then drawn off at the high speed.

8 Claims, 1 Drawing Figure

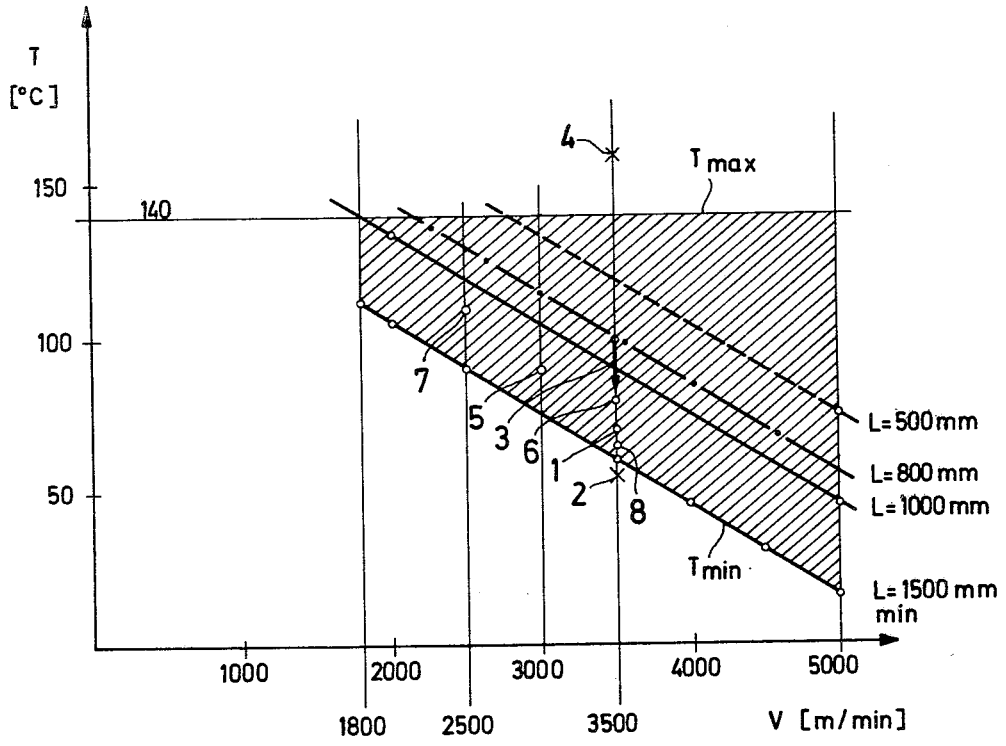
T
[°C]
150
140
100
50
4
T max
7
5
3
6
1
2
8
T min
L=500mm
L=800mm
L=1000mm
L=1500 mm
min
1000
2000
3000
4000
5000
1800
2500
3500
V [m/min]

PROCESS FOR HIGH-SPEED SPINNING OF POLYAMIDES

This is a continuation of application Ser. No. 670,042, filed Mar. 24, 1976, now abandoned.

BACKGROUND OF THE INVENTION

The invention relates to a process for the high-speed spinning and the take-up of polyamides, wherein the spun threads after emerging from the spinnerets first pass through a cooling zone and then are subjected to a heat treatment in a spinning duct at a preselected temperature. After this heat treatment the threads are subjected to a finishing and moistening operation, and subsequently are drawn off at speed rates of 1800 to 5000 m/min, stretched and finally wound up.

In the manufacture of polyamides such as polyamide-6 and polyamide-66, the spinning and take-up process is reliably mastered today up to draw-off speeds of the order of 1300 m/min. With a view to improving the productivity of a plant it would be desirable to be able to increase substantially the draw-off speed. It is known that increasing the draw-off speed changes the physical properties of the threads to such an extent that the drawn and textured yarn is of inferior quality and/or that the stretching of such material involves an increased number of capillary breaks. Moreover, the water balance in the threads is unfavorably affected.

When spinning polyamides, specific difficulties arise in winding-up the spun threads. At the above-mentioned conventional spinning speeds, increased wetting and steaming of the threads in the spinning duct, because of an elevated water content, result in a stable winding operation. This is not the case at increased speeds. High thread running speeds lead generally to unstable packages, an occurrence which is accompanied by operational disturbances and results in waste accumulation. On the other hand, it has been discovered when applying high temperatures in the spinning duct—e.g., by means of superheated steam—that the product packages shrink tightly on the tubes and/or exhibit extensive unevenness of the threads and, consequently, cannot be processed further. With rapid or high-speed spinning, the take-up operation is the weakest link in the chain. Since the technical and economic value of a process as a whole is judged by the smooth operation of all process steps, great importance must be attached to the winding operation.

THE PRIOR ART

French Pat. No. 976,505 discloses a process for the high-speed spinning of polyamide threads at thread draw-off and take-up speeds of over 4500 m/min. All process parameters such as temperature profile, residence times in heat treatment areas etc. are not disclosed. It has been discovered that serviceable packages generally are not obtained following the above teaching and that further creative considerations are required to determine the remaining process parameters.

Swiss Pat. No. 357,144 discloses a process for the high-speed spinning of thermoplastics at take-up speed rates of up to 2600 m/min, wherein the threads, immediately upon extrusion, are passed through a spinning duct heated to a temperature of 10° to 80° C. below the melting temperature of the polymer and subsequently cooled by an air blast. Thus, from the spinnerets the thread temperature is continuously dropping. This process does not provide a sufficiently reliable take-up operation. Neither do the specifications describe the nature of the packages. The object of this process, unlike our invention, is the maintenance of a high draw ratio and an elevated output in the spinning section respectively. The specified temperature profile does not affect the thread behaviour in the plastic zone so as to facilitate the take-up operation.

In German Provisional Patent Publication No. 2,117,659 a process is described wherein draw-off speeds of over 2000 m/min are used. In this case the threads, upon emerging from the spinnerets, are first cooled to below the freezing point and subsequently heated to temperatures above the freezing point.

The publication illustrates by means of a standard example that heating to a temperature lower than the freezing point, e.g., to 60° C. in the case of polyethyleneterephthalate, is disadvantageous. The threads are said to have a reduced tenacity, a high elongation and high shrinkage values, and to be useless without subsequent stretching. On the contrary, we have discovered that, upon surpassing their freezing temperature, the threads show a tendency to stick and exhibit comprehensive thread unevenness, the consequence being packages shrunk tightly on the tube. Such threads are unusable for further reprocessing.

THE INVENTION

The present invention has as its object the provision of a process for high-speed spinning and take-up which, despite high thread running speed rates, produces stable packages and threads of high uniform quality with a minimum of operational disturbances.

The object is achieved according to the invention in providing heat treatment in a spinning duct, the walls of which are heated to a temperature $T_{max}$ of 140° C. and at least to a temperature $T_{min}$ which is determined according to the following equation:

$$T_{min} = \frac{5500 - v}{33} + T_a \text{ (°C.)}$$

where v is the draw-off speed of the threads in m/min and $T_a$ is a temperature value dependent upon the length of the spinning duct and equal to zero for a spinning duct length of 1500 mm and over and for shorter spinning duct lengths equal to 6° C. for each 100 mm reduction in spinning duct length.

The invention may be illustrated graphically. In the annexed Figure, the thread running or take-up speed rates v are marked in m/min on the abscissa and the wall temperature T of the spinning duct in °C. on the ordinate. The curves illustrate perfectly reproducible conditions, in contrast to the thread temperatures, mentioned with respect to the technical standard, which are difficult to determine and always have to be interpreted in conformity with the measuring method.

The FIGURE shows a cross-hatched area which is limited at the top by the maximum wall temperature $T_{max}$ in the form of a horizontal line, and at the bottom by the line $T_{min}$ corresponding to the above equation. The line $T_{min}$ conforms to the following Table:

| v (m/min) | $T_{min}$ (°C.) |
|---|---|
| 1800 | 112 |
| 2000 | 106 |

-continued

| v (m/min) | $T_{min}$ (°C.) |
|---|---|
| 2500 | 90 |
| 3000 | 90 |
| 3500 | 60 |
| 4000 | 45 |
| 4500 | 30 |
| 5000 | 15 |

The successful operation of the process also is affected by the residence time of the thread in the spinning duct and the heated section of the spinning duct. With one exception, the tests described in the examples were carried out in spinning ducts of a length of 2000 mm. It was discovered unexpectedly that within the specified range of speeds a reduction in length to 1500 mm produced no marked change in the conditions. Only with a large reduction to a length of 800 mm (standard example 3) were the results useless. By raising the temperature to 120° C., it was possible to compensate for the duct length reduction, and the accompanying reduced heat transfer to the running thread. The lower line $T_{min}$, therefore, corresponds to a spinning duct length of L=1500 mm and over, the parallel line just above to a length of L=1000 mm, the dash-dotted line to a length of L=800 mm, and the broken line to a length of L=500 mm, which is of theoretical value. It has been discovered that a reduction of the length L below 1500 mm necessitates for each 100 mm an increase of $T_{min}$ by 6° C. whereas an elongation of the heated spinning duct length beyond 1500 mm entailed no substantial alterations of the conditions.

Within the area according to the invention the duct temperature may be selected essentially at random for all yarn counts occurring in practice. In the case of specific quality requirements (e.g., special dyeing behaviour) of the finished yarn it has been discovered that the duct temperature is an additional spinning parameter which must be controlled to obtain specific characteristics in the thread. Thus, with respect to the yarn count the tendency is evident that for finer titers a higher temperature must be chosen within the range and vice versa because finer titers cool down quicker than heavier titers before entering the spinning duct. In the case of threads spun in the titer range of 20 to 100 dtex—relative to the spun titer—we have found the walls of the spinning duct should be heated to a temperature between $T_{min}$ and $T'=T_{min}+25°$ C.

In the FIGURE a number of points are entered and marked with the numerals 1 to 8. This indexing corresponds to the numbering of the specific examples which are described below.

It was discovered unexpectedly that, by following the teaching of the invention, results not obtainable by conventional methods are realized. The threads produced are characterized by an improved stress-strain behaviour which allows the formation of a stable package which may be handled, stored and transported without any difficulty. The threads are then either drawn and textured as usual or simultaneously draw-textured. The threads produced according to the invention run smoothly during the draw-texturing operation and impart to the yarn excellent textile physical properties.

The threads produced according to the invention undergo, in comparison with conventionally manufactured threads, a supplementary orientation and crystallization. This structural modification may be ascertained, inter alia, by the change of the thread birefringence and the density. A further characteristic of the threads, which may be measured, is the deviation in their length after the spinning operation. The thread is subjected immediately after spinning to a length measurement to determine the deviation of the length with time, in accordance with the take-up time.

With the thread produced according to the invention the length after spinning remains unchanged, i.e., the thread grows neither longer nor shorter during its run and during winding. This behaviour may be the reason why a stable package formation is obtained. The yarn is uniform along the thread length and during further processing the structural formation results in remarkable textile yarn properties including very good dyeability. Parameters with respect to the thread quality and further advantages are given in the specific examples.

For the sake of comparison, the package formation was studied, under otherwise the same spinning conditions, at too low spinning duct temperatures (standard example 2) and at too high spinning duct temperatures (standard example 4). At too low temperatures, namely below the area hatched in the Figure, a lengthening of the thread took place and, during the winding, resulted in a unstable yarn package and a collapsing of the package. At too high temperatures, a shortening of the thread took place during the winding which resulted in a package tightly shrunk on the tube. Because of irregular shrinking conditions in the package, e.g., at the two bobbin ends and in the center, yarn unevenness such as periodic Uster fluctuations occurred. In both cases, the product was useless.

The invention and the advantages obtained by it are all the more unexpected when considering the increased thread running speeds. According to the Figure, lower temperatures are required at or in the spinning duct when the speed is increased, although the residence time drops with increased thread running speeds. The contrary would have been expected. With regard to the length of the spinning duct, dimensioning remains practical so that the plant has, on the one hand, not too great a height but, on the other hand, a sufficient length to produce the desired results. Useful lengths are of the order of 800 to 3000 mm.

The process according to the invention may be still further improved in its efficiency if a gaseous medium is fed into the spinning duct at a temperature that equals substantially the wall temperature of the spinning duct.

The advantages of the process of the invention will be illustrated more particularly in the specific examples and standard (prior art) examples. The essential process parameters of all examples have been compiled in a synoptical table at the end of the specification. This Table also includes—as far as possible—the numerically evaluable textile data of the intermediate and end products.

EXAMPLE 1

Polyamide-66 of the relative viscosity ($n_{rel}$) of 2.4 was melted at 295° C. and spun in a quantity of 34 g/min through a spinneret plate with 24 holes, each hole having a diameter of 0.25 mm.

The emerging threads were cooled to a temperature of 70° C. in a blow duct of a length of 1750 mm by means of a transverse flowing air stream of the temperature of 20° C. and the velocity of 0.8 m/sec. The thread temperature was measured by a commercially available convection measuring probe known as 'Transmet.'

Subsequently, the threads passed through a vertical spinning duct 2000 mm in length, having its walls heated to a temperature of 70° C. The thread temperature below the spinning duct was about 70° C. The threads were then treated with finish, moistened and wound up at a speed of 3500 m/min. The titer of the spun thread was 100/24 dtex.* Further quality data characterizing the thread structure are compiled in the Table. The wound thread produced a stable and uniform package, and the package hardness was very uniform. A thread end subjected immediately after the spinning and take-up operation to a length measurement showed no thread length deviation with time. During the winding operation the thread length remained unchanged which resulted in an excellent yarn evenness.

*Yarn weight in grams per 10,000 meters in length

Threads produced in such a manner were then reprocessed in a simultaneous draw-texturing process applying a temperature of 200° C. and a draw ratio of 1:1.27. The quality characteristics of the yarn produced in such a manner are compiled in the Table. Knitted stockings made from this yarn are characterized by a uniform and streak-free dyeability.

EXAMPLE 2

(Standard Example)

Polyamide-66 threads are spun and wound up under the same conditions as those described in example 1, except that the temperature of the heated spinning duct was set to 55° C. This point is marked in the FIGURE with '2' and is located outside the hatched area according to the invention. Such treatment resulted in a collapsing of the package on the tube so that a yarn package could not be produced. The measurement of the change in thread length directly after the spinning operation revealed a thread lengthening of about 1% within a few minutes so that an unstable package was the unavoidable consequence.

EXAMPLE 3

(Standard Example)

Polyamide-66 threads were spun and wound up under the same conditions as those described in example 1, except that the length of the heated spinning duct was reduced to 800 mm and the temperature of the spinning duct was set at 100° C. The area below 100° C. is marked 3 in the FIGURE. It is located below the line valid for a reduced duct length and marked L=800 mm, i.e., beyond the reduced area valid in this instance. The consequence was a collapsing of the package on the tube as in example 2. With all other spinning and take-up conditions remaining the same, the retreatment residence time and temperature were obviously interdependent, in which case the shorter residence time of the thread in the heated spinning duct had to be balanced by raising the duct temperature to more than 100° C.

EXAMPLE 4

(Standard Example)

Polyamide-66 threads were spun and wound up under the same conditions as those described in example 1, except that the temperature of the spinning duct was set at 160° C. This point is marked 4 in the FIGURE and is located outside the hatched area according to the invention. The consequence was a package shrunk tightly on the tube with marked package edges which were conspicuous by a periodic mass unevenness along the thread. Such a package formation is useless. The measurement of the change in thread length immediately after the spinning operation revealed a reduction in the thread length of about 2% within a few minutes after spinning.

EXAMPLE 5

Polyamide-66 threads were spun under the same conditions as those described in example 1, except that the velocity of the cooling air was 1.2 m/sec, the temperature of the spinning duct 90° C. and the take-up speed 3000 m/min.

Because of the prolonged residence time of the threads in the cooling zone and the increased air blast velocity, the threads were cooled down to 62° C. as they passed from the blow duct, or 8° below those in example 1. A stable thread package and a very good thread evenness were obtained.

The quality of the threads produced in such a manner and further reprocessed according to the simultaneous draw-texturing process are compiled in the Table. The dyeability was very good.

EXAMPLES 6–8.

Polyamide-6 of the relative viscosity ($n_{rel}$) of 2.68 was melted at 255° C. and extruded through a spinneret plate with 10 (examples 6, 7) and 16 (example 8) holes respectively, of a diameter of 0.3 mm. The extruded threads were cooled to a temperature of the order of 75° C. in a blow duct of a length of 1750 mm by a transverse-flowing air stream of a temperature of 20° C. and a velocity of 2.0 m/sec. Subsequently, the threads passed through a spinning duct 2000 mm in length having its walls heated to different temperatures, namely to 80° C. (example 6), 110° C. (example 7), and 65° C. (example 8).

The threads were then treated with a finish and moistened and wound up at speeds at 3500 m/min (example 6), 2500 m/min (example 7), and 3500 m/min (example 8). The titer of the threads and further quality characteristics may be gathered from the Table. The wound threads formed a stable and uniform package. The dyeability also was very good.

All the points of the examples 1 and 5 through 8 illustrating the invention are located within the hatched area according to the FIGURE.

TABLE

| Example No. | 1 | 2 | 3 | 4 | 5 | 6 | 7 | 8 |
|---|---|---|---|---|---|---|---|---|
| Type of Example | Inv. | Stand | Stand | Stand | Inv. | Invention | | |
| Polymer | Polyamide-66 | | | | | Polyamide-6 | | |
| Rel. Viscosity $n_{rel}$ | 2.4 | | | | | 2.68 | | |
| Spinn. Temp. (°C.) | 295 | | | | | 255 | | |
| Spinneret Hole Dia. (mm) | 0.25 | | | | | 0.30 | | |
| Blow Duct Length (mm) | 1750 | | | | 1750 | 1750 | | |

TABLE-continued

| Example No. | 1 | 2 | 3 | 4 | 5 | 6 | 7 | 8 |
|---|---|---|---|---|---|---|---|---|
| Type of Example | Inv. | Stand | Stand | Stand | Inv. | Invention | | |
| Quench Air Temp. (°C.) | | 20 | | | 20 | | 20 | |
| Air Velocity (m/sec) | | 0.8 | | | 1.2 | | 2.0 | |
| Thread Temp. (°C.) | | 70 | | | 62 | | 75 | |
| Spinn. Duct Length Heated (mm) | 2000 | 2000 | 800 | 2000 | 2000 | 2000 | 2000 | 2000 |
| Spinn. Duct Temp. (°C.) | 70 | 55 | <100 | 160 | 90 | 80 | 110 | 65 |
| Draw-off Speed (m/min) | 3500 | 3500 | 3500 | 3500 | 3000 | 3500 | 2500 | 3500 |
| | Thread Properties | | | | | | | |
| 1. Spun Thread | | | | | | | | |
| Titer (dtex) | 100/24 | — | — | — | 115/24 | 200/10 | 200/10 | 160/16 |
| Breaking Load (g) | 340 | — | — | — | 365 | 730 | 500 | 540 |
| Elongation at Break (%) | 80 | — | — | — | 98 | 102 | 116 | 110 |
| Birefringence | $43 \cdot 10^{-3}$ | — | — | — | $41 \cdot 10^{-3}$ | $32 \cdot 10^{-3}$ | — | $64 \cdot 10^{-3}$ |
| 2. Draw-Textured Yarn | | | | | | | | |
| Titer (dtex) | 81/24 | — | — | — | 85/24 | — | — | — |
| Tenacity (g/dtex) | 4.2 | — | — | — | 3.9 | — | — | — |
| Elongation at Break (%) | 35 | — | — | — | 38 | — | — | — |
| Draw Ratio | 1:1.27 | — | — | — | 1:1.40 | — | — | — |

It is to be understood that the embodiment of the invention which has been described is merely illustrative of one application of the principles of the invention. Numerous modifications may be made to the disclosed embodiment without departing from the true spirit and scope of the invention.

What is claimed is:

1. Process for high-speed spinning and take-up of polyamide spun filaments emerging from spinnerets comprising:

(a) cooling the filaments to a temperature of 50°–90° C., (b) passing the cooled filaments through a steamless spinning duct the walls of which are heated to a preselected temperature below 140° C. and above $T_{min}$, wherein $T_{min}$ is calculated from the following equation:

$$T_{min} = \frac{5500 - v}{33} + T_a \text{ (°C.)}$$

with v=draw-off speed through the spinning duct in m/min, said speed being between 1800 and 5000 m/min and wherein $T_a$ is a constant temperature value of 0 for spinning ducts 1500 mm or greater in length, and a positive constant which is a function of the length of the spinning duct for a duct length less than 1500 mm as follows:

$$T_a = \frac{6(1500 - \text{length of spinning duct in millimeters})}{100},$$

(c) subjecting the heat-treated filaments to a finishing and moistening operation, and (d) subsequently drawing the filaments off at a speed of between 1800 and 5000 m/min.

2. The process of claim 1 wherein said spun threads have a titer of 20 to 100 dtex (relative to the spun titer) and said temperature is between $T_{min}$ and $T=T_{min}+25°$ C.

3. The process of claim 1 wherein a gaseous medium is fed into said spinning duct having a temperature substantially equal to said wall temperature.

4. The process of claim 1 wherein the threads are drawn off over godets.

5. The process of claim 1 wherein said polyamide is polycaprolactam.

6. The process of claim 1 in which said polyamide is polyamide-66.

7. The process of claim 1 in step (a) is performed by subjecting said threads to an air blast having a temperature between 15° and 120° C.

8. The process of claim 1 in step (a) is performed by subjecting said threads to an air blast having a temperature between 16° and 36° C.

* * * * *